US006475127B1

(12) United States Patent
Koenig

(10) Patent No.: US 6,475,127 B1
(45) Date of Patent: Nov. 5, 2002

(54) WEIGHT LIFTER'S BENCH

(76) Inventor: Jeret C. Koenig, 515 Court St., Williamsburg, IA (US) 52361

( * ) Notice: Subject to any disclaimer, the term of this patent is extended or adjusted under 35 U.S.C. 154(b) by 0 days.

(21) Appl. No.: 09/641,130

(22) Filed: Aug. 16, 2000

(51) Int. Cl.[7] ..... A63B 26/00
(52) U.S. Cl. ..... 482/142; 482/104
(58) Field of Search ..... 482/142, 104–108

(56) References Cited

U.S. PATENT DOCUMENTS

| | | | | |
|---|---|---|---|---|
| 4,396,191 | A | 8/1983 | Metler | |
| 4,974,840 | A | * 12/1990 | Welch | 272/134 |
| 5,290,213 | A | 3/1994 | Sheikowitz | |
| 5,350,346 | A | 9/1994 | Martinez | |
| 5,616,108 | A | 4/1997 | Hayden | |
| 5,772,561 | A | 6/1998 | Hayden | |
| 5,924,964 | A | 7/1999 | Hayden | |
| 5,989,163 | A | * 11/1999 | Rodgers | 482/70 |
| 6,152,866 | A | * 11/2000 | Kuo | 482/142 |

* cited by examiner

*Primary Examiner*—Jerome W. Donnelly
*Assistant Examiner*—Lori Baker Amerson
(74) *Attorney, Agent, or Firm*—Siemans Patent Services, LC

(57) ABSTRACT

A weight bench having an inclining seat assembly and a weight support which can be pushed away from the seat assembly to afford ready egress from the seat assembly. The bench includes a frame to which the seat assembly is pivotally attached, a spring adjustably anchored to the frame and to the seat assembly, and a foot rest. The spring urges the seat assembly into an upright position, but yields to the weight of a person sitting in the seat assembly. The seat assembly includes a seat and a seat back fixed to one another such that they incline in tandem. The bench has a weight supporting tray fixed to a support staff pivotally mounted to the frame of the bench at the lower end of the support staff. The support staff is constrained to pivot towards and away from the seat back in an arcuate path not deviating from a vertical position by more than forty-five degrees. The support staff is located on the frame such that when it inclines toward the seat assembly, the tray is at shoulder height and at arm's length from the seat back.

8 Claims, 5 Drawing Sheets

10
14
16
18
20
22
24
26
28
30
40
12
B

WEIGHT LIFTER'S BENCH

BACKGROUND OF THE INVENTION

1. Field of the Invention

The present invention relates to weight lifting equipment, and more particularly to an improved bench for weight lifters. The bench is usable by individual consumers, by commercial gymnasiums, in schools, military, and other institutions, and wherever people use dumbbells and barbells.

2. Description of the Prior Art

Weight lifting has become popular as a sport, method of improving body condition, and as a disciplinary exercise. A widespread form of weights is that wherein weights are carried on bars, such as dumbbells and barbells. Many of the individual exercises which are performed during weight lifting are performed with the lifter seated or lying on a bench. It is considerably more comfortable and ergonomically suitable to have the seat incline during various phases of weight lifting. The prior art has proposed weight lifting benches wherein the seat back inclines. An example is seen in U.S. Pat. No. 4,396,191, issued to Keith R. Metler on Aug. 2, 1983. The distal end of the seat back is fixed to a horizontal supporting structure, and the proximal end is fixed to and travels along a vertical supporting structure which also raises and lowers a weight supporting cradle. As the seat back inclines, its proximal end is raised or lowered. The seat remains horizontal. The weight supporting cradle raises or lowers accordingly. By contrast, in the present invention, both the seat and its associated seat back incline in tandem, so that the seat itself inclines from the horizontal or other prior orientation. Meter lacks a return mechanism which acts to return the seat and seat back to the upright position, this being a feature of the present invention. The return mechanism includes resilient resistance to inclination, which enables the seat to incline gradually as it yields to weight of the user as he or she reclines. In a further difference with Metler, the weight supporting tray of the present invention is not linked to the seat back, and can be inclined independently of seat inclination.

U.S. Pat. No. 5,350,346, issued to Guillermo Martinez on Sep. 27, 1994, illustrates a weight bench wherein the seat back and the seat can incline from the horizontal direction independently. However, the device of Martinez lacks resilient resistance to inclination, as seen in the present invention. Also, the seat itself is independently inclinable relative to the seat back in discrete increments, whereas in the present invention, these objects incline in fixed relation to one another along a continuous arcuate path. Martinez lacks the inclining weight supporting tray of the present invention.

U.S. Pat. No. 5,290,213, issued to Jeff Sheikowitz on Mar. 1, 1994, shows a weight bench wherein the seat back can be adjusted to plural inclined positions. However, the available positions are fixed, and are spaced apart from one another along a series of fixed distance intervals. By contrast, the seat back in the present invention pivots continuously throughout its range of motion, rather than being limited to a selection of discrete positions, and has a resilient resisting member urging the seat back to return to the upright position. The seat in the present invention inclines in tandem with the seat back, in contrast to the device of Sheikowitz. The present invention includes an inclinable weight supporting tray absent in the device of Sheikowitz.

A movable weight supporting cradle is shown in U.S. Pat. No. 5,616,108, issued to Richard C. Hayden on Apr. 1, 1997.

However, the cradle pivots about a transversely oriented horizontal support bar. The support bar cannot be pivoted out of the way to afford egress to a person seated on an associated weight bench, as occurs in the present invention. There is no inclining seat in the device of Hayden, unlike the present invention.

U.S. Pat. No. 5,924,964, issued to Richard C. Hayden on Jul. 20, 1999, illustrates a weight supporting cradle which is horizontally adjustable. However, the adjustment concerns transverse positioning of the cradle elements along a supporting transverse bar. This bar and its vertical support posts cannot pivot out of the way to afford egress to a person seated on the associated weight bench, as seen in the present invention. There is no inclining seat in the horizontally adjustable cradle invention.

None of the above inventions and patents, taken either singly or in combination, is seen to describe the instant invention as claimed.

SUMMARY OF THE INVENTION

The present invention provides a weight bench wherein a seat assembly having a seat and seat back inclines to a desired position for working out. As the seat assembly inclines, it compresses a resilient resisting element so that inclination proceeds smoothly and continuously, but not abruptly. This feature enables a person working out with dumbbells and barbells to assume the most comfortable or advantageous body position when working out. The resilient resisting element urges the seat back into the upright position, thereby automatically returning the seat to a normal position when the user leaves the bench. Also, spring force assists the user to the upright position when he or she may be tired or weakened by strenuous exercise.

The bench includes an associated weight supporting tray which is located at shoulder height and at arm's length from a person initially seated in the seat. The tray is pivotally supported in front of the seat, so that the tray can be pivoted out of the way of a person arising from the seat. A user can place dumbbells or barbells into the tray, and then push away the tray to enable easy egress from the weight bench.

Accordingly, it is one object of the invention to provide a weight bench wherein the seat and seat back pivot or incline as a unit.

An additional object of the invention is to provide a weight bench wherein the height of the seat is adjustable.

Still another object of the invention is to provide a weight bench wherein the foot rest is adjustable.

Another object of the invention is to provide a weight bench offering comfortable and advantageous positions for those who work out with dumbbells and barbells.

It is still another object of the invention that inclination of the seat and seat back proceed smoothly and continuously.

An additional object of the invention is to provide a weight bench wherein the degree of inclination of the seat and seat back is adjustable.

Still another object of the invention is to provide a means of increasing or decreasing the resistance in the inclination of the seat and seat back.

It is a further object of the invention that the seat of the weight bench be automatically returned to an upright position and that it assist the user in regaining an upright position after exercising.

Still another object of the invention is to provide a weight supporting tray which can be pushed out of the way to afford ready egress from the weight bench.

It is another object of the invention to provide a chain on the weight supporting tray which will prevent the weights from accidently falling from the tray onto the user.

Yet another object of the invention is to provide a weight supporting tray which can be locked into the upright position to afford an added measure of safety from the weights falling from the tray onto the user.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIES

Figure 1:
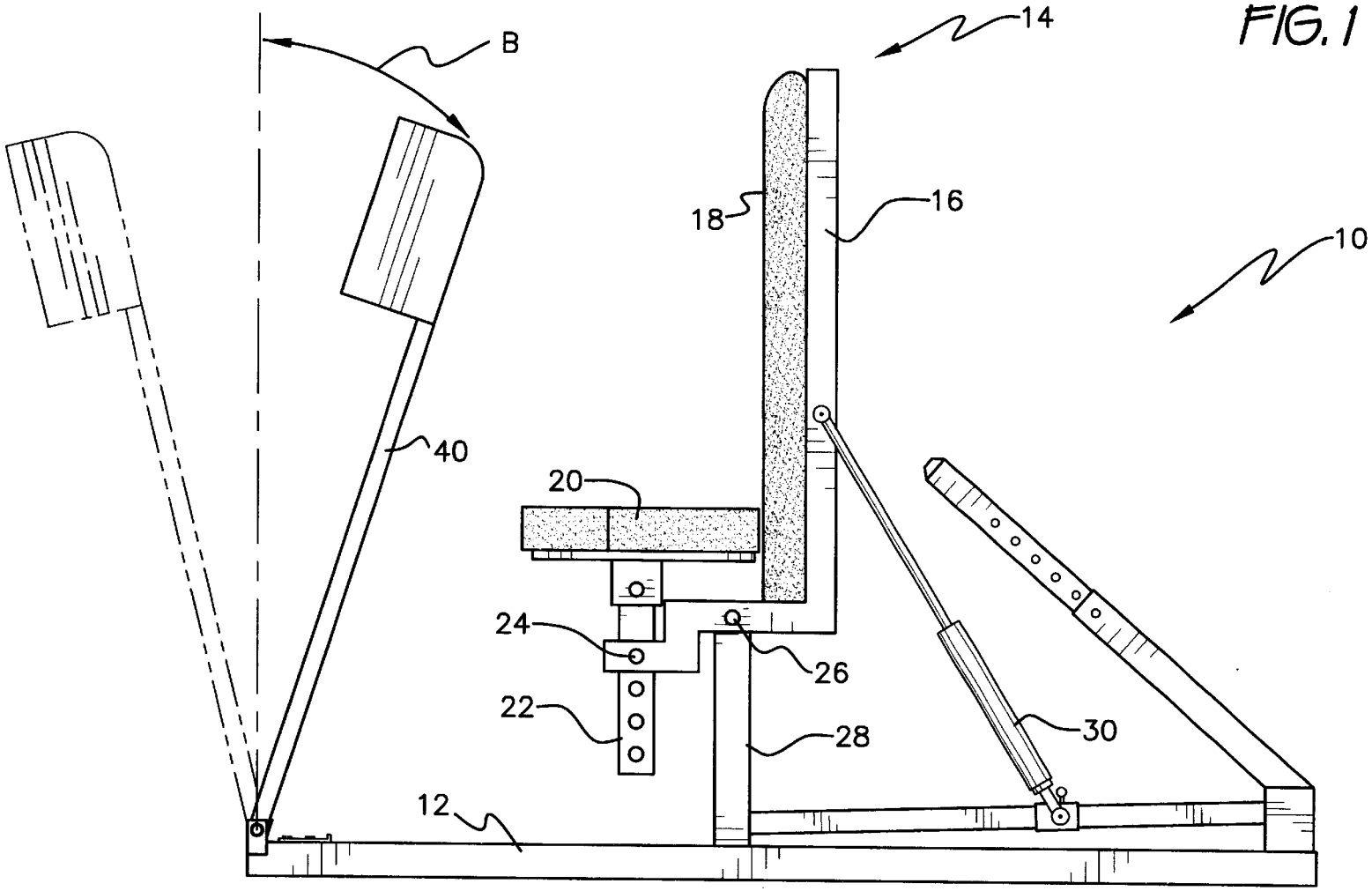
FIG. 1 is a side elevational view of an embodiment of the invention, showing the seat in an upright position.

Turning now to FIG. 1 of the drawings, weight bench 10 is seen to comprise a frame 12 supporting a seat frame assembly 14. Seat frame assembly 14 includes seat frame 16, a seat back 18 affixed thereto. Seat 20 is mounted upon the upper end of seat adjustment frame 22, which passes through the forward portion of seat frame 16 and is secured in incremental positions by adjustment pin 24. Seat frame 16 is pivotally supported on frame 12 by a pivot pin 26 which passes through seat frame 16 and is anchored within upright post 28 of frame 12.

Bench 10 enables a user to recline from the upright position shown in FIG. 1 in a smooth, progressive, continuous motion along the longitudinal length of bench 10 when seated. Seat assembly 14 is movable between an upright position wherein seat back 18 is substantially vertically oriented and a reclined position shown in FIG. 2. The direction of motion is indicated by arrow A in FIG. 2. A resistance mechanism prevents seat assembly 14 from flopping to the front and to the rear in uncontrolled fashion. The resistance mechanism comprises an expansible spring element anchored at one end to frame 12 and at an opposite end to seat frame 16. In the embodiment of FIG. 1, the spring element is a pneumatic or gas spring 30 disposed to yieldingly resist inclination of seat assembly 14 as seat assembly pivots into the reclined position of FIG. 2.

Figure 5:
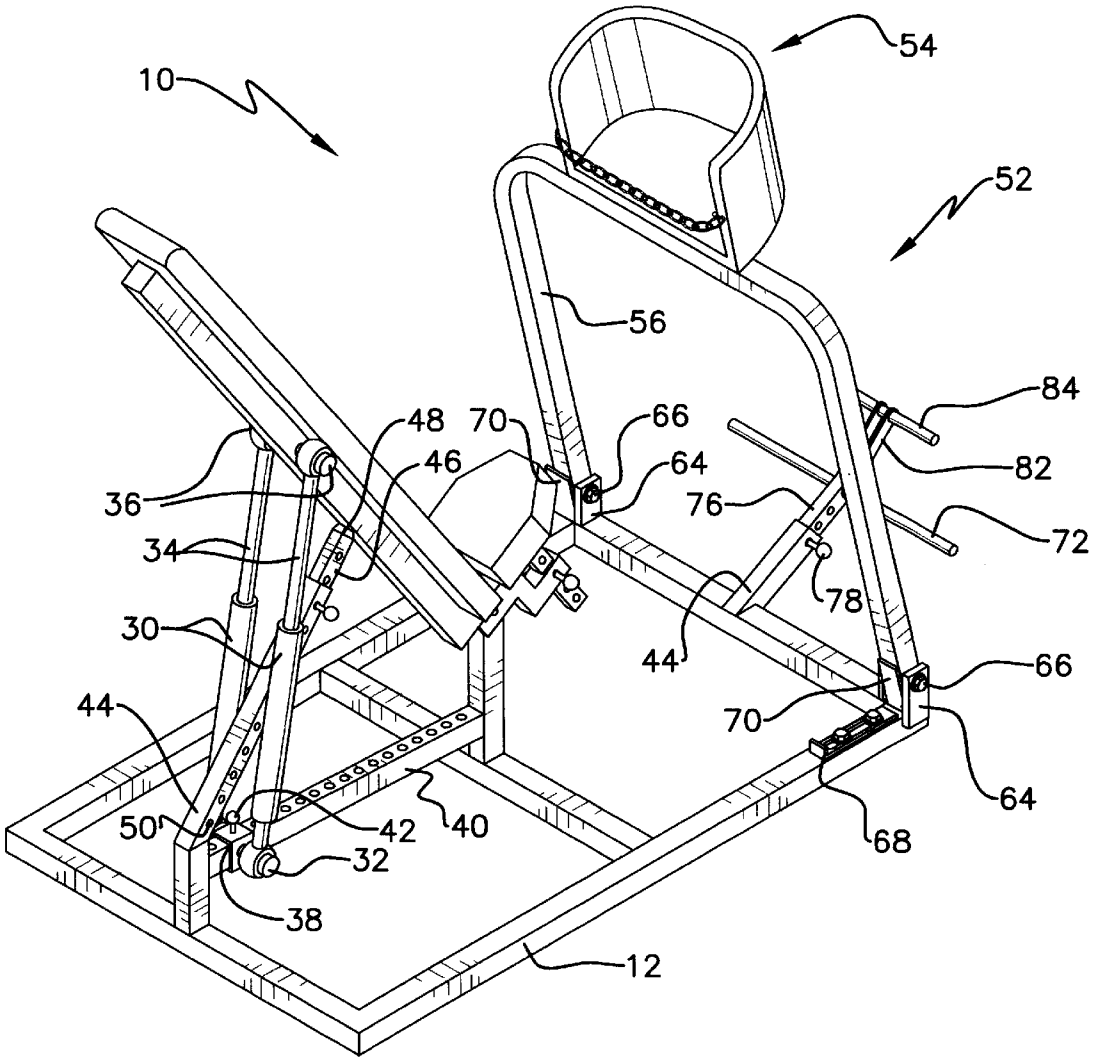
FIG. 5 is a perspective view of an embodiment of the invention adapted to accommodate both barbells and dumbbells.

Referring to FIG. 5, gas spring 30 is biased to expand, thereby automatically returning seat assembly 14 to the upright position of FIG. 1 when a user leaves bench 10. Gas spring 30 is pivotally anchored by a pivot pin 32 to resistance adjustment slide 38 which engages resistance adjustment bar 40 with inclination adjustment pin 42, and at its proximal end has an extension arm 34 pivotally attached to the seat frame 16 by a pivot pin 36. Inclination resistance may be adjusted by moving resistance adjustment slide 38 to various pin holes along inclination resistance bar 40 and securing it with inclination adjustment pin 42.

Figure 2:
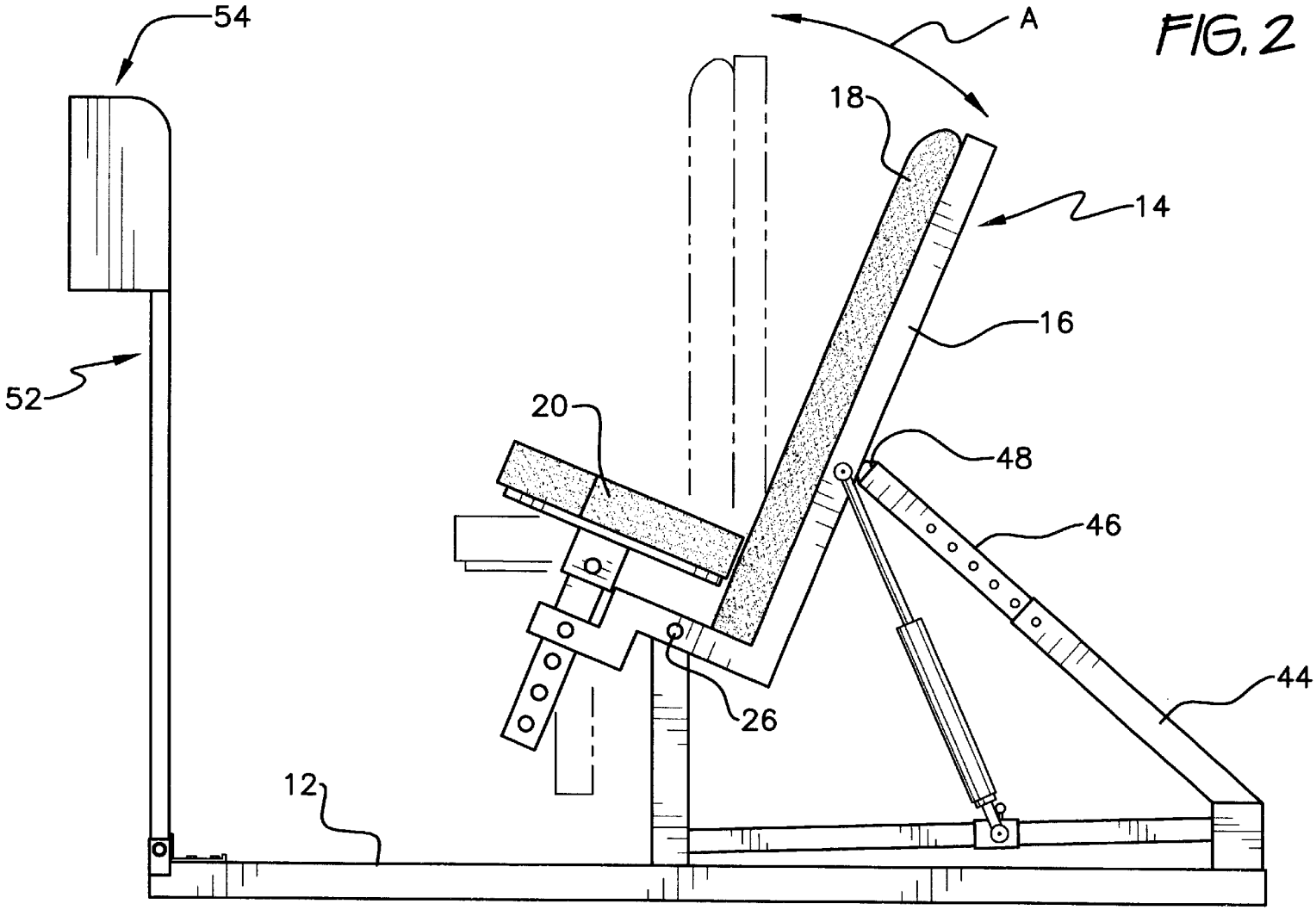
FIG. 2 is similar to FIG. 1, but shows the seat in an inclined position.

Stop 46 is fixed to frame 12 by a post 44, and has a resilient cushion or bumper 48. A series of holes 50 formed in the two telescoping sections of post 44 accept pin 42, so that post 44 may be adjusted in height. In FIG. 2, seat assembly 14 is shown at its greatest degree of inclination, having contacted stop 46.

Figure 3:
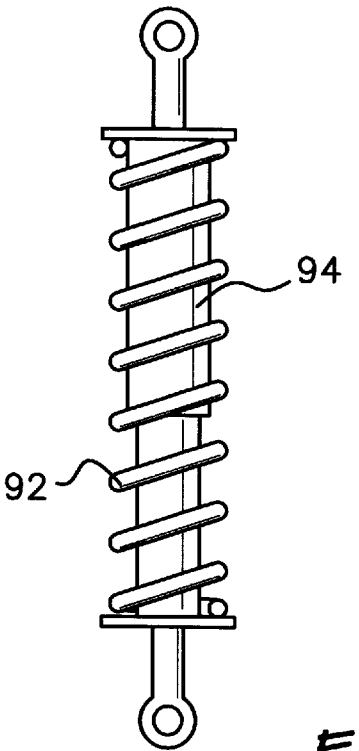
FIG. 3 is a side elevational detail view of an alternative embodiment of a component shown in FIG. 1.

Referring now to FIG. 3, it would be possible to substitute a coil spring 92 having a pneumatic damper 94 for the gas spring 30 shown in FIGS. 1 and 2. Damper 94 dampens the rate of expansion and compression of spring 92. Spring 92 is biased to expand so as to operate in a manner similar to that of gas spring 30, as described above, and engages pins 32 and 36 in a manner similar to that of gas spring 30.

Figure 4:
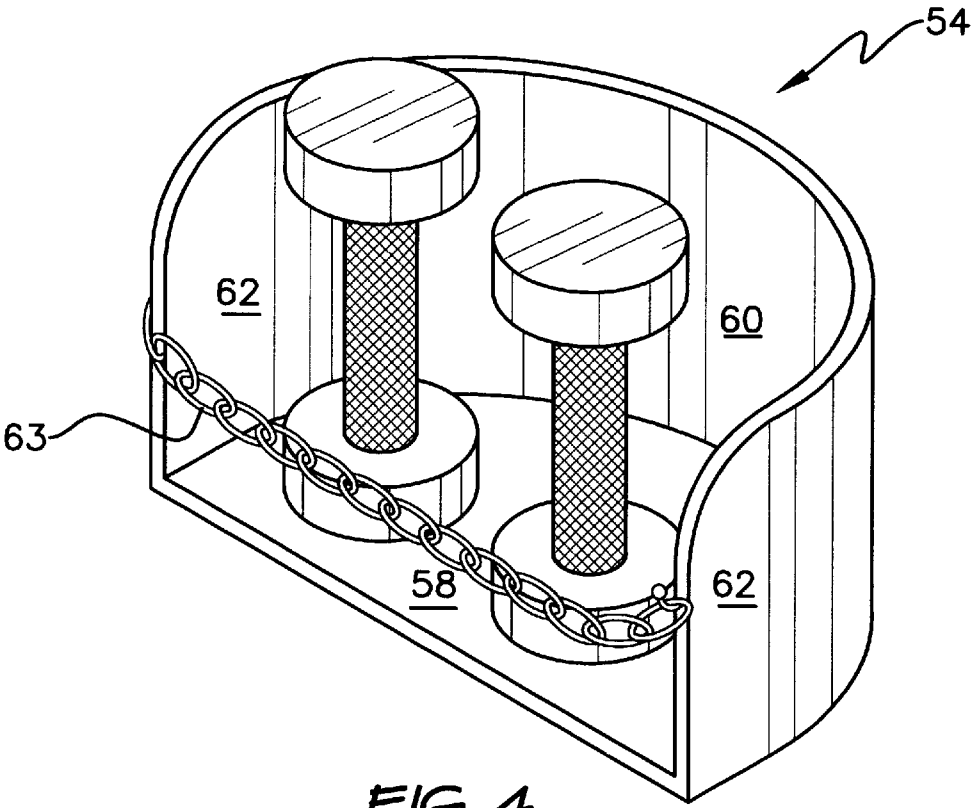
FIG. 4 is an environmental, perspective view of the weight holding tray of the embodiment of FIG. 1.

Again referring to FIG. 5, bench 10 includes a weight support 52 for receiving and holding dumbbells when a person working out desires to set the dumbbells aside. Weight support 52 includes a tray 54 dimensioned and configured to receive dumbbells (not shown) laid on one end, placed therein from there above, and a support staff 56. Seen better in FIG. 4, tray 54 comprises an upwardly open trough which can engage and retain the dumbbells. Tray 54 has a flat floor 58, an upright rear wall 60, and end walls 62. The trough is oriented such that dumbbells cannot fall out by gravity when tray 54 is in the position of FIG. 2, but safety chain 63 is provide to ensure added safety. When a user is seated on seat assembly 14 and is ready to grasp the barbells, then drawing tray 54 towards seat assembly 14 inclines the trough such that the dumbbells readily slide towards the user, and chain 63 may be disengaged to free the dumbbells for use. Tray 54 remains in the position of FIG. 1 until the user sets the dumbbells in tray 54 and pushes tray 54 away towards the position of FIG. 2 and repositioning chain 63 prior to standing up.

The proximal end of staff 56 is fixedly attached to and supports tray 54 in a location above frame 12. The distal end of staff 56 is pivotally connected to frame 12 by a pivoting attachment element such as clevis 64 and pivot pin 66. When engaged, lock 68 prevents pulling weight support 52 forward. Location of the pivotal connection of the distal end of staff 56 to frame 12 below the proximal end enables tray 54 to approach seat back 18 and swing away therefrom to accommodate setting aside of the weight when the weight is placed in tray 54. Weight support 52 is dimensioned and configured such that tray 54 is located at about shoulder height with respect to seat assembly 14, and at arm's length from seat back 18. Dimensions determined by shoulder height and arm's length, as employed herein, correspond to typical dimensions of the physiology of a human adult.

Weight support 52 swings in an arcuate path as shown in FIG. 1. When support 52 is in the position shown in broken lines in FIG. 1, it will not obstruct a user as he or she climbs out of weight bench 10. The degree of pivot, indicated by arrow B, is limited to a maximum of forty-five degrees of inclination from a vertical direction in both forward and rearward directions. This is accomplished by stop 70 fixed to frame 12 to limit pivot of staff 56. Adjustable T-shaped foot rest 72 is affixed to the forward member of frame 12. Foot rest sleeve 74 is attached at its proximal end to frame 12. Foot rest bar 76 slides into foot rest sleeve 74, engaging with foot rest adjustment pin 78. Foot rest extension 82 allows supplemental foot rest 84 to pivot on the end of foot rest bar 76 for additional adjustability.

Figure 6:
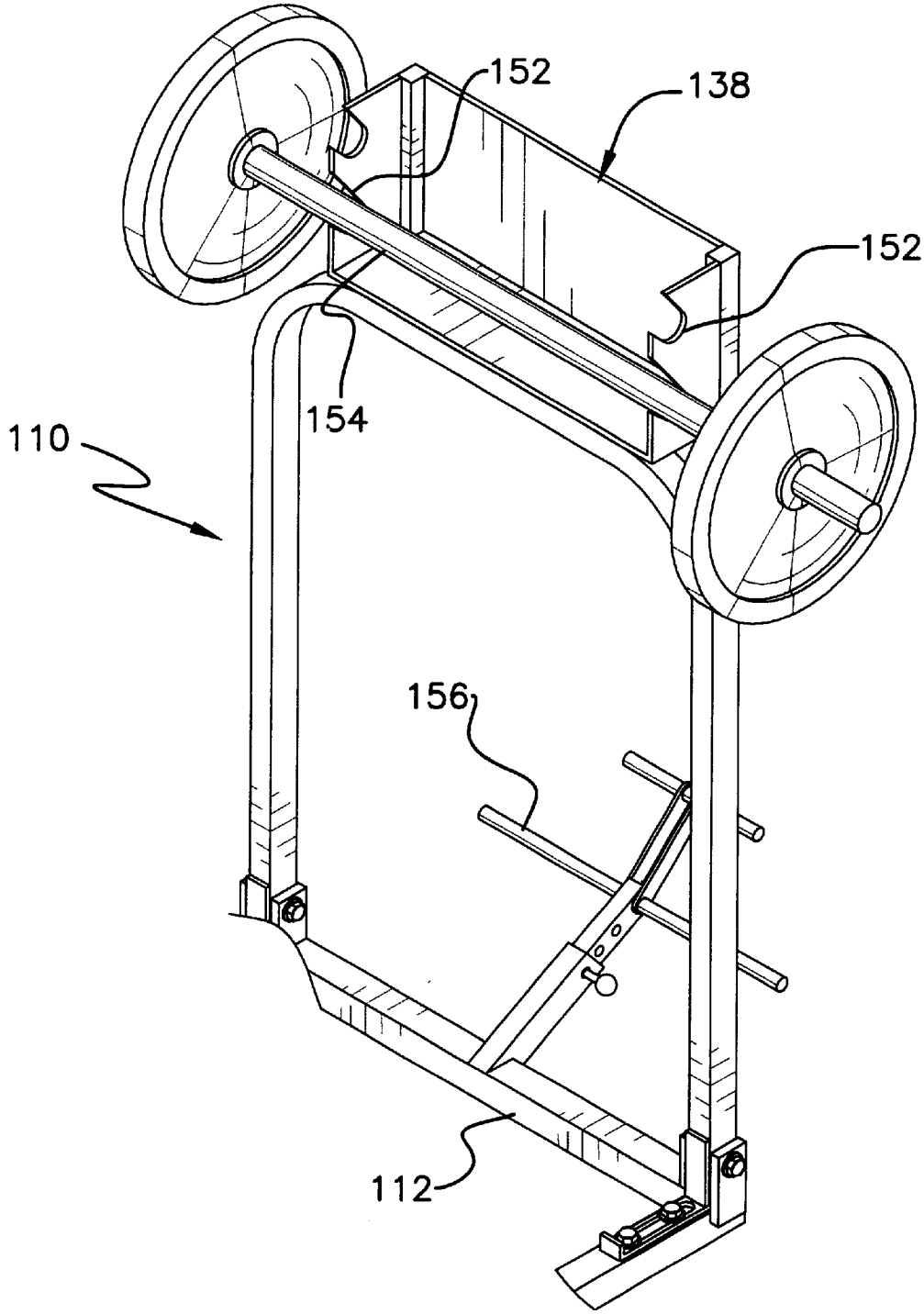
FIG. 6 is an environmental perspective detail view showing a barbell supported in the embodiment of FIG. 5.

FIG. 6 illustrates an embodiment of the invention wherein weight bench 110, although similar to the embodiment of FIG. 1 in many respects, is adapted to receive barbells in weight tray 138. Slots 152 are formed in the side walls of tray 138 for this purpose. Barbells 154 (see FIG. 6) may be placed in slots 152. Thus, tray 138 accommodates both barbells and dumbells.

A T-shaped foot rest 156 is affixed to the forward member of frame 112.

The various embodiments of the present invention is susceptible to variations and modifications which may be introduced thereto without departing from the inventive concept. For example, the frame may be modified to include legs (not shown) spacing the seat assembly farther from the ground than would be the case without such legs. Alternatively, the frame may be modified to be fixed to an environmental object rather than to rest on the floor. In a further example, the weight support could be located other than as illustrated herein, provided that the tray were located as described above, and could move away from the seat assembly to afford egress. Similarly, the resistance mechanism could be incorporated into the post of the frame, or otherwise located, if desired.

It is to be understood that the present invention is not limited to the embodiments described above, but encompasses any and all embodiments within the scope of the following claims.

I claim:

1. A weight bench enabling a user to recline in a smooth, progressive, continuous motion, comprising:

a frame;

a seat assembly comprising an adjustable height seat and a seat back, wherein said seat assembly is pivotally supported on said frame and is continuously movable between an upright position wherein said seat back is substantially vertically oriented and a predetermined reclined position defined by an adjustable, telescoping stop member;

an adjustable resistance mechanism disposed to yieldingly resist inclination of said seat assembly as it pivots into said reclined position from said upright position and to return said seat assembly into said upright position when a user leaves said weight bench, said resistance mechanism comprising an expansible spring element rotatably connected at a first end to said seat assembly and adjustably connected at a second end to said frame, and said resistance to inclination is varied by selecting a point on said frame where said mechanism is selectively secured; and said adjustable stop disposed to limit the travel of said seat assembly from said upright position toward said predetermined reclined position a weight support for receiving and holding a weight, wherein said weight support includes a tray dimensioned and configured to receive barbells and dumbbells placed therein from there above, a support staff having a proximal end attached to and supporting said tray above said frame and a distal end, a pivoting attachment element pivotally connecting said distal end of said support staff to said frame of said weight bench, and stops limiting pivot of said support staff, wherein said distal end of said support staff is below said proximal end of said support staff.

2. The weight bench according to claim 1, wherein said resistance mechanism comprises an expansible spring element anchored at one end to said frame and at an opposite end to said seat assembly, wherein said expansible spring element is disposed to expand and to urge said seat assembly into said upright position.

3. The weight bench according to claim 2, wherein said expansible spring element comprises a pneumatic spring.

4. The weight bench according to claim 2, wherein said expansible spring element comprises a coil spring and a damper damping the rates of expansion and compression of said coil spring.

5. The weight bench according to claim 1, further comprising a foot rest affixed to said frame.

6. The weight bench according to claim 1, wherein said weight support is dimensioned and configured such that said tray is located at about shoulder height with respect to said seat assembly and at arm's length from said seat back, wherein shoulder height and arm's length correspond to typical dimensions of the physiology of a human adult.

7. The weight bench according to claim 1, wherein said stops limit pivot of said support staff to a maximum of forty-five degrees of inclination from a vertical direction.

8. A weight bench enabling a user to recline in a smooth, progressive, continuous motion, comprising:

a frame having a foot rest;

a seat assembly comprising a seat and a seat back, wherein said seat assembly is pivotally supported on said frame and is movable between an upright position wherein said seat back is substantially vertically oriented and a reclined position;

an expansible spring element disposed to yieldingly resist inclination of said seat assembly as it pivots into said reclined position from said upright position and to return said seat assembly into said upright position when a user leaves said weight bench, wherein said expansible spring element is anchored at one end to said frame and at an opposite end to said seat assembly, wherein said expansible spring element is disposed to expand and to urge said seat assembly into said upright position, wherein said expansible spring element has means for adjusting position of anchorage along said frame;

a weight support for receiving and holding a weight, wherein said weight support includes a tray dimensioned and configured to receive a weight placed therein from thereabove, a support staff having a proximal end attached to and supporting said tray above said frame and a distal end, a pivoting attachment element pivotally connecting said distal end of said support staff to said frame of said weight bench, and stops limiting pivot of said support staff to a maximum of forty-five degrees of inclination from a vertical direction, wherein said distal end of said support staff is below said proximal end of said support staff, wherein said weight support is dimensioned and configured such that said tray is located at about shoulder height with respect to said seat assembly and at arm's length from said seat back, wherein shoulder height and arm's length correspond to typical dimensions of the physiology of a human adults.

* * * * *